US008776296B2

(12) United States Patent
Park et al.

(10) Patent No.: US 8,776,296 B2
(45) Date of Patent: Jul. 15, 2014

(54) METHOD FOR CONTROLLING WASHING MACHINE

(75) Inventors: Eun Jin Park, Gyeongsangnam-do (KR); Deug Hee Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 512 days.

(21) Appl. No.: 12/344,944

(22) Filed: Dec. 29, 2008

(65) Prior Publication Data

US 2009/0172893 A1 Jul. 9, 2009

(30) Foreign Application Priority Data

Dec. 31, 2007 (KR) ..... 10-2007-0141558

(51) Int. Cl.
*D06F 33/00* (2006.01)

(52) U.S. Cl.
USPC ..... 8/158; 8/137; 8/159

(58) Field of Classification Search
None
See application file for complete search history.

(56) References Cited

U.S. PATENT DOCUMENTS

| | | | | |
|---|---|---|---|---|
| 5,671,617 | A * | 9/1997 | Park et al. | 68/53 |
| 5,737,790 | A | 4/1998 | Badger et al. | |
| 7,585,374 | B2 | 9/2009 | Sechelmann | |
| 2003/0089137 | A1 * | 5/2003 | Jo et al. | 68/12.27 |
| 2004/0025544 | A1 * | 2/2004 | Kim et al. | 68/3 R |
| 2004/0139557 | A1 | 7/2004 | Seo et al. | |
| 2004/0144135 | A1 * | 7/2004 | Oh et al. | 68/12.16 |
| 2004/0187529 | A1 * | 9/2004 | Kim et al. | 68/207 |
| 2004/0237603 | A1 * | 12/2004 | Kim et al. | 68/15 |
| 2006/0191078 | A1 | 8/2006 | Kim et al. | |
| 2007/0157396 | A1 * | 7/2007 | Won et al. | 8/158 |

FOREIGN PATENT DOCUMENTS

| | | | |
|---|---|---|---|
| DE | 10328071 | A1 | 1/2005 |
| JP | 3-63097 | A | 3/1991 |
| JP | 6-327881 | A | 11/1994 |
| JP | 9-94372 | A | 4/1997 |
| KR | 10-0192292 | B1 | 1/1999 |
| WO | WO 2006/101363 | A1 | 9/2006 |

* cited by examiner

*Primary Examiner* — Michael Kornakov
*Assistant Examiner* — Ryan Coleman
(74) *Attorney, Agent, or Firm* — Birch, Stewart, Kolasch & Birch, LLP

(57) ABSTRACT

A controlling method of a washing machine is disclosed. The controlling method of a washing machine includes washing laundry accommodated in a drum provided in the washing machine, primarily rinsing the washed laundry and an inside of the drum, using clean wash water, primarily dewatering the rinsed laundry and secondarily rinsing the dewatered laundry, using clean wash water.

14 Claims, 6 Drawing Sheets

METHOD FOR CONTROLLING WASHING MACHINE

CROSS REFERENCE TO RELATED APPLICATION

This application claims the benefit of the Patent Korean Application No. 10-2007-0141558, filed on Dec. 31, 2007, which is hereby incorporated by reference as if fully set forth herein.

BACKGROUND OF THE DISCLOSURE

1. Field of the Disclosure

The present invention relates to a method for controlling a washing machine. More particularly, the present invention relates to a method of rinsing laundry accommodated in a washing machine.

2. Discussion of the Related Art

Washing machines are electric home appliances which wash clothes, cloth items and beddings (hereinafter, laundry), using both detergent and mechanical friction. Such the washing machines may be categorized based on a position of a door into top-loading type washing machines and front-loading washing machines. In a top-loading type washing machine, a tub is vertically provided in a housing to accommodate laundry, with a top portion being open, and the laundry is loaded into the tub via an opening formed at a top of the housing, in communication with the open top portion of the tub. In a front loading type washing machine, a drum is horizontally provided in a housing to accommodate laundry, with an open front facing a front of the washing machine, and the laundry is loaded into the drum via an opening formed at a front of the housing, in communication with the open front of the drum. In both the top-loading and front-loading type washing machines, a door is coupled to the housing to open and close the opening of the housing.

According to such the washing machines, the laundry is rinsed to remove remaining detergent and dirt after a washing cycle. However, it may occur quite often in the conventional washing machine that the remaining dirt and detergent are not removed completely even after the rinsing. In addition, to remove the remaining dirt and detergent completely, the rinsing should be performed continuously for a substantially long time. Because of that, such the rinsing requires much wash water and a long time.

SUMMARY OF THE DISCLOSURE

Accordingly, the present invention is directed to a controlling method for a washing machine.

An object of the present invention is to provide a controlling method of a washing machine capable of rinsing washed laundry effectively and efficiently.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a controlling method of a washing machine includes washing laundry accommodated in a drum provided in the washing machine; primarily rinsing the washed laundry and an inside of the drum, by supplying clean wash water only to a minimum water level in which the laundry is submerged; primarily dewatering the rinsed laundry; and secondarily rinsing the dewatered laundry, using clean wash water.

The primary rinsing of the washed laundry and the inside of the drum may further include rotating the drum for a predetermined time period, the drum rotating together with the minimum level of wash water and the laundry; and discharging the minimum level of the wash water outside.

The controlling method may further include secondarily washing the laundry, continuously using the wash water used in the washing of the laundry, prior to the primarily rinsing of the washed laundry and the inside of the drum. The secondary washing of the laundry, using the used wash water, may include washing the laundry and separating detergent simultaneously. The secondary washing of the laundry may include diluting the wash water used in the washing of the laundry. The secondary washing of the laundry may include additionally supplying clean wash water to the wash water used in the washing of the laundry. Moreover, the secondary washing of the laundry, using the wash water used in the washing of the laundry, may include additionally rotating the drum for a predetermined time period after the additional supplying of clean water to the wash water used in the secondary washing of the laundry; and discharging the wash water after the additional rotating of the drum.

The primary dewatering of the laundry may further include removing contaminants stacked between the drum and the tub accommodating the drum. The removal of the contaminants may include washing out or flushing an outer circumferential surface of the drum and an inner circumferential surface of the tub facing the outer circumferential surface of the drum. Specifically, the removal of the contaminants may include supplying a predetermined small amount of water to space between the drum and the tub during the rotation of the drum; and forming a flow of water rotating between the drum and the tub by a rotational force of the drum. The removal of the contaminants is performed while a motor rotating the drum stops during the dewatering. The removal of the contaminants may be performed immediately when a motor rotating the drum stops during the dewatering. The supplying of the small amount of water to the space between the drum and the tub may be performed immediately when a motor rotating the drum stops.

According to an exemplary embodiment of this controlling method, detergent and contaminants can be separated from the laundry completely, with using a substantially short time and small wash water. As a result, the controlling method makes the laundry rinsed more effectively and efficiently.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts. Embodiments of the present invention will be described in reference to a front-loading type washing machine as shown in the accompanying drawings and the embodiments may be applicable to a top-loading type washing machine without substantial change of the design.

Figure 1:
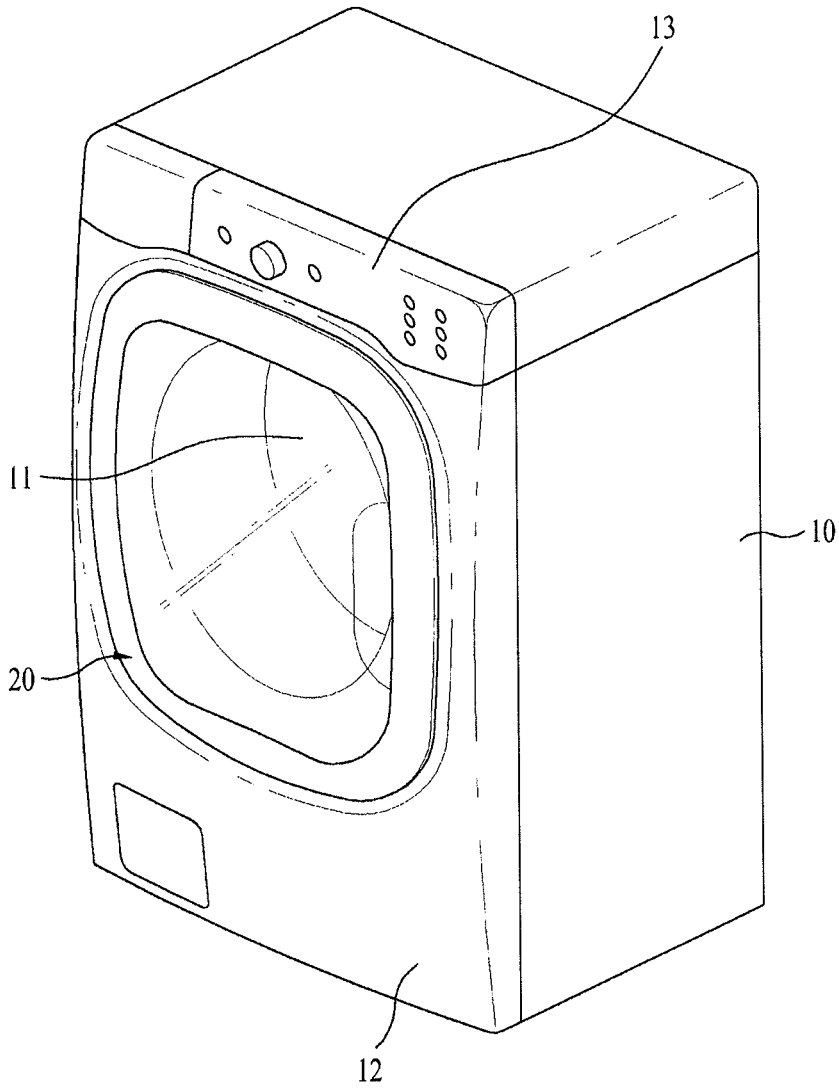
FIG. 1 is a perspective view schematically illustrating a washing machine.
Figure 2:
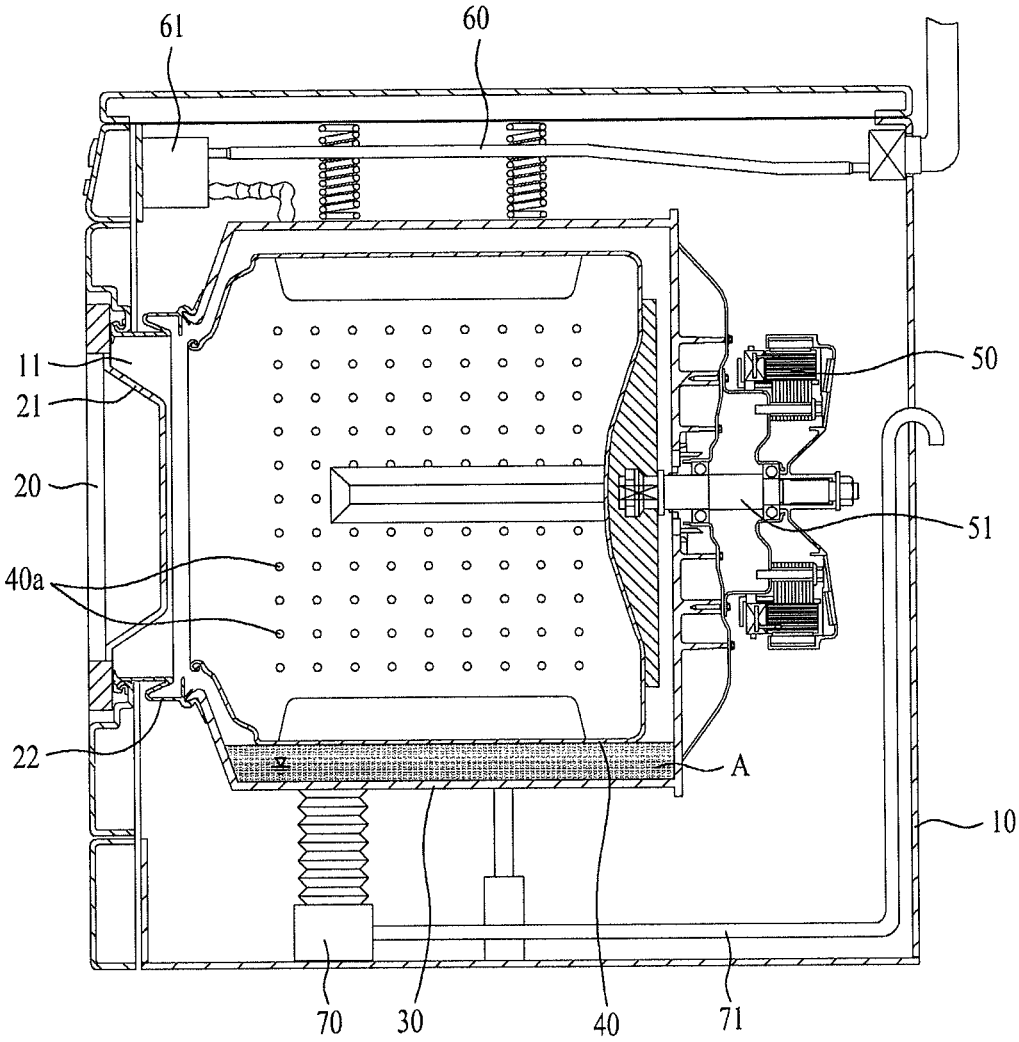
FIG. 2 is a sectional view illustrating the washing machine of FIG. 1.

FIG. 1 is a perspective view illustrating a washing machine and FIG. 2 is a sectional view illustrating the washing machine shown in FIG. 1.

As shown in FIG. 1, the washing machine basically includes a housing 10, a tub 30 and a drum (40, see FIG. 2). The housing defines an exterior appearance of the washing machine. The tub 30 and the drum 40 are installed in the housing 10. A front cover 12 is coupled to a front of the housing 10 to form a front surface of the washing machine and a control panel 13 is mounted on the front cover 12 for a user to operate the washing machine. An opening 11 is formed at a front surface of the housing 10 and the opening 11 is closable by a door 20 coupled to the housing 10. As shown in FIG. 1, the door 20 is circular-shaped typically and it may be substantially rectangular-shaped. Such the rectangular door 20 makes an introduction portion of the opening 11 and the introduction opening of the drum 40 look large to the user. As a result, it is advantageous to enhance an exterior appearance of the washing machine. As shown in FIG. 2, a door glass 21 is provided at the door 20 and the user can see through the inside of the tub and drum 30 and 40 because of the door glass 21. Also, a gasket 22 is provided between the opening 11 and the tub 30 to prevent the laundry and wash water from coming out.

In reference to FIG. 2, the tub 30 is installed in the housing 10 and it stores wash water. The drum 40 is rotatable in the tub 30. A spring or damper may be provided as a damping device when the tub 30 is installed in the housing 10 to dampen vibration which may be generated during the operation of the tub 30. The tub 30 and the drum 40 are provided horizontally for their introduction openings to face the front of the housing 10. As mentioned above, the introduction openings of the tub and drum 30 and 40 are in communication with the opening 11 of the housing 10. As a result, if the door 20 is opened, the user can load the laundry into the drum 40 via the opening 11 and the introduction openings of the tub and drum 30 and 40. The tub 30 may be fabricated of plastic material to reduce its weight as well as the production cost. At the drum 40 may be formed a plurality of through-holes 40*a* for wash water of the tub 30 to come into the drum 40. In addition, a predetermined power device connected with the drum 40 is installed adjacent to the tub 30. Specifically, the power device is configured of a motor 50 installed at a rear surface of the tub 30. The motor 50 is directly connected with the drum 40 by a rotational shaft 51. If the motor 50 rotates, the drum is also rotated by the rotational shaft 51.

A water supply pipe 60 is connected with an external water supply source and the water supply pipe 60 is connected with the tub 61 via a detergent box 61. As a result, wash water is supplied to the tub 30 through the water supply pipe 60 and the detergent box 61 from the external water supply source. Here, detergent may be supplied to the tub 30 from the detergent box 61 selectively together with the wash water. On the other hand, a water drain pump 70 is connected with the tub 30 and the water drain pump 70 is connected with a water drain pipe 71. As a result, used wash water is discharged from the washing machine from the tub 30 via the water drain pump 70 and the water drain pipe 71.

Figure 3:
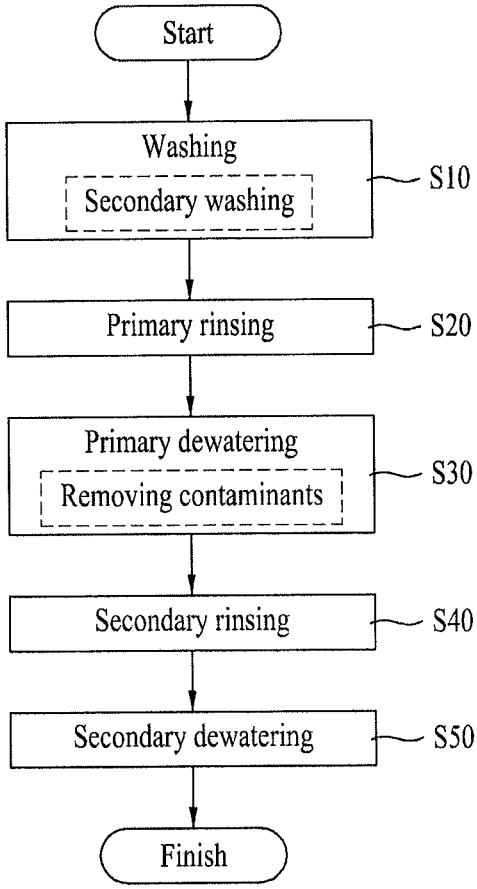
FIG. 3 is a flow chart illustrating a controlling method for a washing machine according to an exemplary embodiment.
Figure 4:
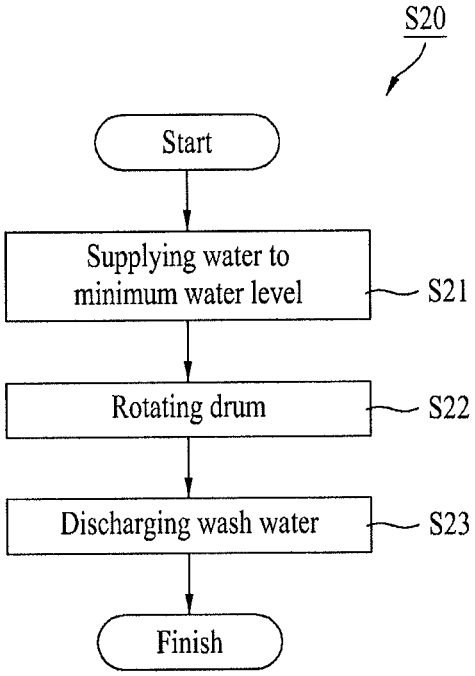
FIG. 4 is a flow chart illustrating primary rinsing of FIG. 3.

Next, a controlling method for the washing machine described above will be described in detail. FIG. 3 is a flow chart illustrating a controlling method for the washing machine.

In reference to FIGS. 3 to 6, first of all, the laundry is washed according to predetermined courses (S10). Here, wash water is primarily supplied to the tub 30 via the water supply pipe 60 in the washing (S10) and the wash water of the tub 30 is supplied to the drum 40 via the through-holes 40*a* (S11). The laundry within the drum 40 is soaked by the supplied wash water to be prepared to be washed. At this time, detergent is supplied together with the wash water. Hence, the drum 40 is rotated in a predetermined direction by the power device. The laundry is rotated together with the rotation of the drum 40 and the laundry is washed by both a mechanical friction with wash water and a chemical action of detergent (S11).

Hence, the washed laundry is primarily rinsed (S20). This primary rinsing (S20) is configured preliminarily and simply for the laundry and for the drum 40, using the substantially minimum amount of the wash water, as specifically shown in FIG. 4.

During the primary rinsing (S20), if the washing (S10) is complete, the used water is discharged outside the washing machine via the water drain pump 70 and the water drain pipe 71. after that, clean water is supplied to both of the tub and rum 30 and 40 via the water supply pipe 60 (S21). During the water supplying (S21), the water is supplied to the drum 40 to a minimum level for the laundry enough to be submerged in. In other words, the water is supplied only to a minimum level among a plurality of levels in which the laundry could be submerged. As mentioned above, since the primary rinsing (S20) is performed only for the preliminary rinsing, much water for complete rinsing is not required in the primary rinsing. However, to gain an effect of proper rinsing, the laundry should be in contact with the water uniformly. As a result, it is necessary that the water should be supplied to the minimum level for the laundry to be submerged in. Under the water of the minimum level, the laundry may be in contact with the clean water uniformly. Here, the water amount and the minimum water level required by the laundry amount may be changeable. For example, the amount of water which will be supplied may be predetermined according to the laundry amount through experiments and such the predetermined wash water amount may be preset in the control part of the washing machine. The amount of the water which will be supplied in various ways may be determined to reach the minimum level for the laundry to be submerged in.

After the water supplying (S21), the drum 40 is rotated at a predetermined speed by the power device (S22). In the rotation (S22), the wash water at the minimum level and the laundry may be rotated together with the drum 40. Bubbles remaining on the drum and the laundry may be removed by the clean wash water primarily. In addition, remaining detergent and dirt may be separated from the laundry in the wash water. After the rotation (S22) is performed for a predetermined time period, the used wash water is discharged out of the washing machine via the water drain pump 70 and the water drain pipe 71 (S23). As the laundry and the drum 40 are preliminarily rinsed in the above primary rinsing (S20), dirt and detergent may be removed from the laundry in the next rinsing. At this time, the laundry may be rinsed economically, because the minimum amount of water is used.

Once the primary rinsing (S20) is complete, the rinsed laundry is dewatered primarily (S30).

Figure 5:
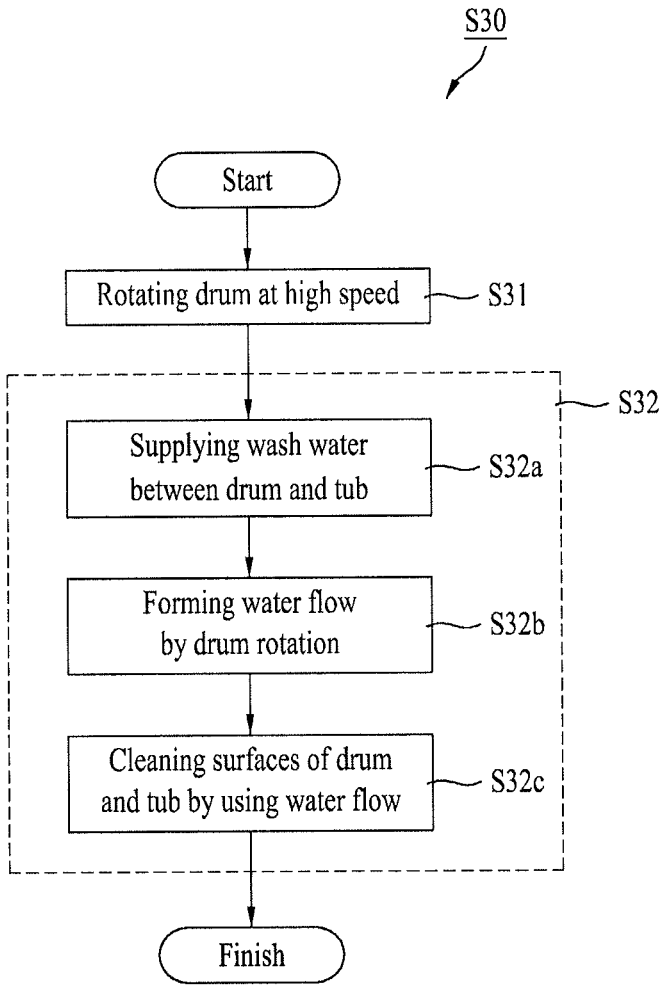
FIG. 5 is a flow chart illustrating primary dewatering of FIG. 3.
Figure 6:
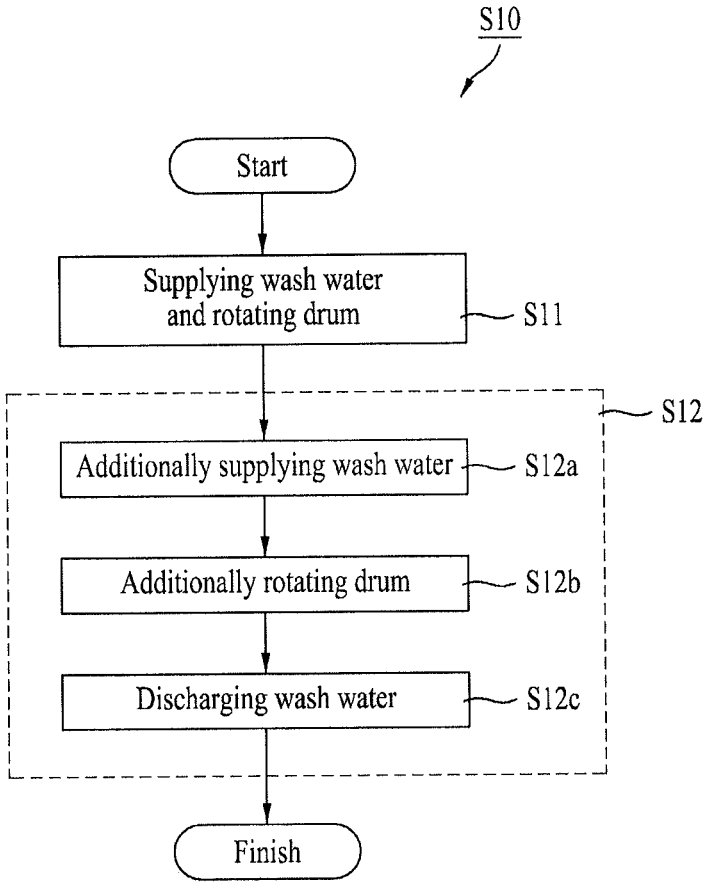
FIG. 6 is a flow chart illustrating washing of FIG. 3.

As shown in FIG. 5, the drum 40 is rotated at a substantially high speed based on preset rotations per minute (S31). Because of that, remaining water may be separated from the laundry by a centrifugal force. To gain a sufficient centrifugal force, the drum 40 should be rotated at a high speed as mentioned above and the rotations per minute of the drum 40 is preset noticeably higher than the rotations per minute of the drum in the prior steps. Such the rotations per minute may be typically 100 rpm. Considering the washing capacity and the substantial amount of laundry, the rotations per minute may be predetermined when the washing starts. The moisture of the laundry may be removed primarily prior to a following secondary rinsing (S40). Even after the primary rinsing (S20), detergent and dirt may still remain on the laundry. However, this detergent and dirt, together with the moisture, can be separated from the laundry by the centrifugal force during the primary dewatering (S30). As a result, the following secondary rinsing (S40) helps both of the dirt and detergent separated completely from the laundry.

All of the used wash water, together with dirt and detergent, is discharged, passing the tub 30 and the drum 40. If the washing machine is used repeatedly, contaminants or contaminants might be stacked up in space between the tub 30 and the drum 40. Especially, such the contaminants are stuck to inner and outer circumferential surfaces of the tub 30 and the drum 40, facing each other, respectively. In the worst case, mold fungus happens to be generated. The contaminants might come into the drum 40 again along the water supplied to the tub 30 only to re-pollute the laundry. As a result, the primary dewatering (S30) may further include removing contaminants between the drum 40 and the tub 30 (S32).

In the removal (S32), an outer circumferential surface of the drum 40 and an inner circumferential surface of the tub 30 are washed out or flushed, such that contaminants stuck to the surfaces may be separated. For this washing out, water may be supplied to the outer circumferential surface of the drum 40 and the inner circumferential surface of the tub 30 in various ways. For example, a nozzle is oriented toward the space between the drum 40 and the tub 30 and water may be sprayed toward the outer circumferential surface of the drum 40 and the inner circumferential surface of the tub 30 from the nozzle. However, this may require an additional device only to cause an increase of the production cost. Because of that, the removal (S32) not requiring the additional device is advantageous in the matter of the production cost, which will be described in reference to FIG. 5 from now on.

While the drum 40 is rotated in the rotation (S31), a substantially small amount of water is supplied to the space between the drum 40 and the tub 30 (S32*a*). This supplying (S32*a*) is similar to the supplying steps described above. That is, water is supplied to the tub 30 via the water supply pipe 60 first. If a large amount of water is supplied here, the water comes into the drum 40 via the through-holes 40*a* only to wet the dewatered laundry. Thus, only the small amount of water is supplied between the tub 30 and the drum 40 not to come into the drum 40. For example, as shown in FIG. 2, the water may be supplied to a predetermined level (A) in the supplying (S32*a*). Specifically, if water is supplied to a predetermined level capable of reaching both side surfaces of the tub 30 and the drum 40, that is, to 'A' level, water may not come into the drum 40.

Hence, the supplied water forms a flow between the drum 40 and the tub 30 (S32*b*). As the drum 40 is rotating, the water is rotated by the rotational force of the drum 40, of course together with the drum 40, from the moment of being supplied. Then, the water forms a flow which rotates along the space between the tub 30 and the drum 40. Such the rotational flow washes out both the outer circumferential surface of the drum 40 and the inner circumferential surface of the tub 30 to remove contaminants stuck to the surfaces. That is, the surfaces of the tub 30 and the drum 40 may be washed out by the formed water currents. After that, the supplied water is discharged together with the water from the dewatered laundry and the separated contaminants.

If the drum 40 is rotated additionally for the removal (S32) in a time period preset for the dewatering, the motor 50 may waste power unnecessarily. Thus, it is preferable that the removal (S32) is performed during a predetermined time period in which the motor 50 stops to operate during the dewatering (S30). Specifically, even if the motor is stopped to operate during the predetermined time period in the dewatering (S30), the drum is rotating continuously for a predetermined time period by the inertial force, not stopping immediately. As a result, even if the water is supplied continuously during the time period of the motor 50 stopping to operate, the drum 40 may form a predetermined rotational flow enough to remove the contaminants. In addition, after the motor 50 stops to operate, the rotation speed of the drum 40 is getting low gradually. Accordingly, it is advantageous to form a preferable rotational flow that the removal (S32*a*), specifically, the supplying (S32*a*) starts immediately when the motor 50 stops to operate. If then, the water may be supplied for 5~20 seconds immediately when the motor 50 stops to operate.

As mentioned above, the removal (S32) may remove the contaminants stuck between the tub 30 and the drum 40 in addition to prevent the laundry from getting wet again. Such the removal of the contaminants prevents the re-pollution of the laundry. The removal (S32) may help the complete separation of the dirt during the following secondary rinsing (S40), like the primary dewatering (S30). Moreover, the removal (S32) may not require any additional devices and it may consume relatively small electricity, in comparison with direct spraying of water. Because of such the reasons, the above removal (S32) has an enhanced efficiency of washing the tub 30 and the drum 40.

In the meanwhile, as well-known in the art which the present invention pertains to, detergent supplied during the washing sticks to the laundry to separate contaminants from the laundry, using a chemical action. Commonly, if rinsing is performed immediately after washing, detergent sticking to the laundry is not separated smoothly and accordingly rinsing may not performed effectively. What is more, a substantially high density of detergent is required to improve washing efficiency and then most wash water is saturated. Because of such the saturated state, the detergent could stick to the laundry more strongly in stead of being separated from the laundry in the water, such that the detergent may not be separated in the following rinsing. Also, remaining contaminants may not be separated from the laundry smoothly because of the same reason as the remaining detergent. The rinsing time and the wash water amount required to remove the detergent sticking to the laundry has to increase noticeably. According to an exemplary embodiment of a controlling method, the washing (S10) may include secondary washing the laundry (S12) which is performed sequentially after the washing (S10) and before the primary rinsing (S20). Such the secondary washing (S12) is performed sequentially after the washing (S11) performed before (hereinafter, 'main washing'). The secondary washing (S12) is configured to continuously use the water used in the main washing (S11) and to separate detergent from the laundry, washing the laundry simultaneously.

The secondary washing (S12) includes supplying clean wash water in addition to the used water of the main washing (S11) (S12*a*). That is, the water used in the main washing (S11) is not discharged and clean water is additionally supplied to the drum 40 via the water supply pipe 60 and the tub 30. For example, the auxiliary water supplying (S12*a*) may be performed for 3~5 minutes. Hence, the drum 40 is rotated for the laundry to be washed, using the water at the increased level (S12*b*). after performing the auxiliary rotation (S12*b*) for a predetermined time period, the used wash water is discharged out of the washing machine to perform the following primary rinsing (S20) (S12*c*).

The density of detergent is decreased a lot, because the laundry amount is increased in the auxiliary water supplying (S12*a*). That is, the wash water is diluted by the auxiliary water supplying (S12*a*). The detergent sticking to the laundry is smoothly separated and dissolved in the diluted wash water. In addition, the separation of detergent is accelerated simultaneously with the washing of the laundry, because the flow of the wash water is generated by the rotation of the drum 40 in the auxiliary rotation (S12*b*). That is, the drum 40 is rotated and auxiliary wash water is supplied simultaneously in the secondary washing (S12). As a result, washing and detergent separation may be achieved simultaneously. Also, the separated detergent may not stick to the laundry again and the laundry may not be polluted again by the separated contaminants, because the wash water is diluted with the flow generated in the drum 40. As a result, the secondary washing (S12) helps the complete separation of contaminants and detergent more effectively than a following secondary rinsing (S40) which will be described later.

Once the primary dewatering (S30) is complete, the primarily dewatered laundry is rinsed secondarily (S40). In the secondary rinsing (S40), clean wash water is re-supplied to the drum 40 and the tub 30. As mentioned above, the primary rinsing (S20) is performed primarily. Thus, in the secondary rinsing (S40), the drum 40 is rotated together with the laundry and detergent and dirt remaining on the laundry may be removed completely, using the clean wash water. Because of the partial removal of the detergent and dirt in the secondary washing, primary dewatering and removal (S12, S30 and S32) mentioned above, the detergent and the contaminants may be removed from the laundry substantially completely in the secondary rinsing (S40). Moreover, because of the appropriate arrangement and configuration of the steps and their sub-steps (S10 to S40), the overall rinsing of the laundry may be performed for a substantially short time period, using the substantially small amount of water and electricity. Considering these aspects, the rinsing of the laundry may be effectively and efficiently according to the exemplary embodiment of the controlling method. Because of the same reason, the drum 40, specifically, an inner circumferential surface of the drum 40 in communication with the laundry may be rinsed clean, as well as the laundry.

After the secondary rinsing (S40), the laundry is dewatered secondarily (S50). In the second dewatering (S50), the drum is rotated at a high speed. As a result, the remaining moisture is completely separated form the laundry by the centrifugal force. If then, the entire washing is complete.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A controlling method of a washing machine comprising:

a washing step for washing laundry accommodated in a drum provided in the washing machine, the washing step comprising a first washing step;

primarily rinsing the washed laundry and an inside of the drum immediately after the washing step, by supplying clean wash water only to a minimum water level in which the laundry is submerged;

primarily dewatering the rinsed laundry using a centrifugal force caused by rotating the drum; and secondarily rinsing the dewatered laundry, using clean wash water, wherein the minimum water level is not higher than a level required to submerge the laundry therein, wherein the primary dewatering of the laundry comprises removing contaminants stacked between the drum and a tub accommodating the drum, and wherein the removal of the contaminants comprises supplying a predetermined amount of water to a space between the drum and the tub during a rotation of the drum, and forming a flow of water rotating between the drum and the tub by a rotational force of the drum.

2. The controlling method of claim 1, wherein the primary rinsing of the washed laundry and the inside of the drum further comprises:

rotating the drum for a predetermined time period, the drum rotating together with the minimum level of wash water and the laundry; and discharging the minimum level of the wash water outside.

3. The controlling method of claim 1, the washing step further comprising:

a second washing step for secondarily washing the laundry, continuously using the wash water used in the washing of the laundry, prior to the primarily rinsing of the washed laundry and the inside of the drum.

4. The controlling method of claim 3, wherein the second washing step, using the used wash water, comprises:

washing the laundry and separating detergent from the laundry simultaneously.

5. The controlling method of claim 3, wherein the second washing step comprises:

diluting the wash water used in the washing of the laundry.

6. The controlling method of claim 3, wherein the second washing step comprises:

additionally supplying clean wash water to the wash water used in the washing of the laundry.

7. The controlling method of claim 6, wherein the second washing step, using the wash water used in the washing of the laundry, comprises:

additionally rotating the drum for a predetermined time period after the additional supplying of clean water to the wash water used in the second washing step; and discharging the wash water after the additional rotating of the drum.

8. The controlling method of claim 6, wherein the additional supplying of the clean water to the wash water used on the second washing step is performed for 3 to 5 minutes.

9. The controlling method of claim 3, wherein the wash water used in the washing of the laundry is held in the drum, without being discharged, prior to the second washing step.

10. The controlling method of claim 1, wherein the removal of the contaminants comprises:

washing out or flushing an outer circumferential surface of the drum and an inner circumferential surface of the tub facing the outer circumferential surface of the drum.

11. The controlling method of claim 1, wherein the removal of the contaminants is performed while a motor rotating the drum stops during the dewatering.

12. The controlling method of claim 1, wherein the removal of the contaminants is performed immediately when a motor rotating the drum stops during the dewatering.

13. The controlling method of claim 1, wherein the supplying of the amount of water to the space between the drum and the tub is performed immediately when a motor rotating the drum stops.

14. The controlling method of claim 1, wherein the supplying of the amount of water to the space between the drum and the tub is performed for 5 to 20 seconds after the motor stops.

* * * * *